United States Patent [19]

Stulbach

[11] Patent Number: 4,934,981

[45] Date of Patent: Jun. 19, 1990

[54] SWINGING TOY

[76] Inventor: Nathan Stulbach, 40 Brighton First Rd., Brooklyn, N.Y. 11235

[21] Appl. No.: 386,358

[22] Filed: Jul. 27, 1989

[51] Int. Cl.[5] ..... A63H 11/08

[52] U.S. Cl. ..... 446/323; 496/322; 496/268

[58] Field of Search ..... 446/236, 253, 314, 315, 446/322, 323, 324, 330; 40/414

[56] References Cited

U.S. PATENT DOCUMENTS

| | | | |
|---|---|---|---|
| 144,651 | 11/1873 | Bancker | 446/323 |
| 152,588 | 6/1874 | Yung | 446/323 |
| 171,703 | 1/1876 | Smith | 446/323 |
| 353,416 | 11/1886 | Hersh et al. | 446/323 |
| 545,541 | 9/1895 | Smith | 446/323 |
| 874,873 | 12/1907 | Sumerlin | 446/323 |
| 929,455 | 7/1909 | Lyon | 446/323 |
| 938,874 | 11/1909 | Klink | 446/323 |
| 1,019,157 | 3/1912 | Hurson | 446/323 |
| 1,088,594 | 2/1914 | Kohler | 446/323 |
| 1,143,495 | 6/1915 | Braught | 446/323 |
| 1,314,205 | 8/1919 | Oseychuk | 446/323 |
| 2,352,895 | 7/1944 | Hayes | 446/323 |

FOREIGN PATENT DOCUMENTS

| | | | |
|---|---|---|---|
| 698378 | 11/1964 | Canada | 446/323 |
| 437766 | 11/1926 | Fed. Rep. of Germany | 446/323 |
| 1027333 | 5/1953 | France | 446/322 |
| 31184 | 4/1904 | Switzerland | 446/323 |
| 55053 | 2/1912 | Switzerland | 446/323 |
| 17352 | 11/1889 | United Kingdom | 446/323 |
| 12922 | 7/1894 | United Kingdom | 446/323 |
| 4282 | 3/1904 | United Kingdom | 446/323 |

*Primary Examiner*—Mickey Yu
*Assistant Examiner*—Sam Rimell
*Attorney, Agent, or Firm*—S. C. Yuter

[57] ABSTRACT

A swinging toy comprises a U-shaped frame having two spaced parallel support rods and a connecting fulcrum rod. A figure comprises a body member simulating a head and shoulders with two arm members rotationally connected to the body member at the simulated shoulders. An outer string line is connected between the parallel support rods near one end of the frame and passes through inner openings of the arm members. An inner string line is connected between the parallel support rods parallel to and adjacent the outer string line and passes through outer openings of the arm members. When the frame is placed in a vertical position with the figure at the top, gravity will cause the body member to move around the inner and outer string lines to take an upside-up position below the inner string line, which causes the inner and outer string lines to cross each other. When the ends of the parallel support rods at the bottom of the frame are moved toward each other, the parallel string lines are pulled back to a parallel position so that the body member counter rotates around the inner and outer string lines back to an upside-up position beneath the inner string line, which causes the inner and outer string lines to cross each other, but in an opposite direction. Repeated movement toward each other of the bottom ends of the parallel support rods causes the body member to repeatedly rotate and counter rotate around the inner and outer string lines. Also disclosed are an electrically-operated embodiment, a weighted free standing embodiment and a multi-jointed figure.

9 Claims, 2 Drawing Sheets

FIG.1
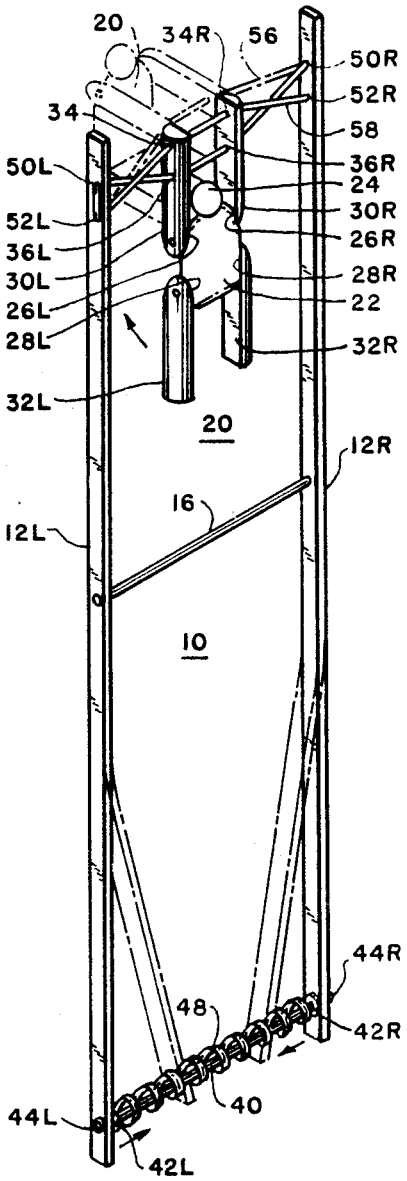
FIG.2
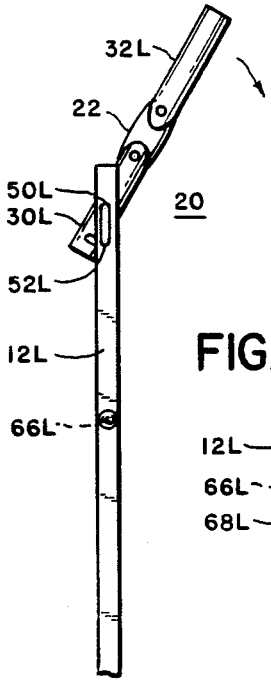
FIG.2A
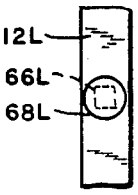
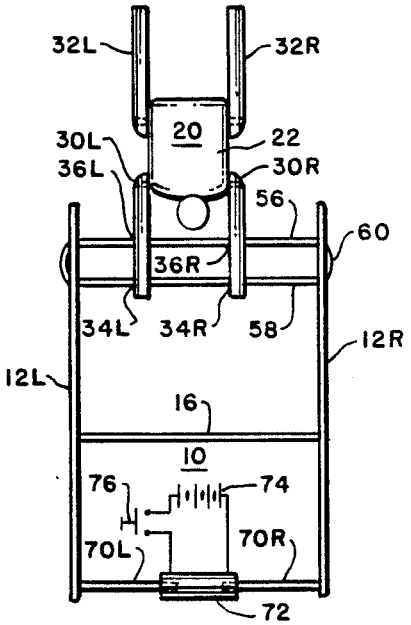
FIG.3

FIG. 7
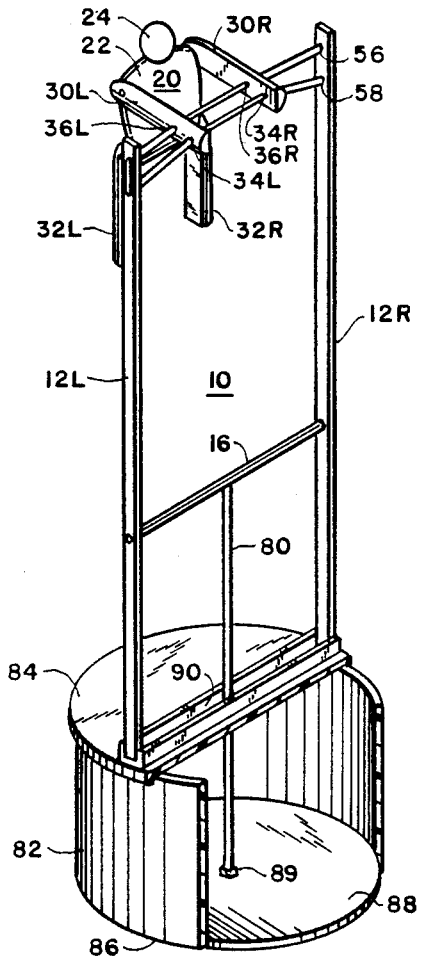
FIG. 4
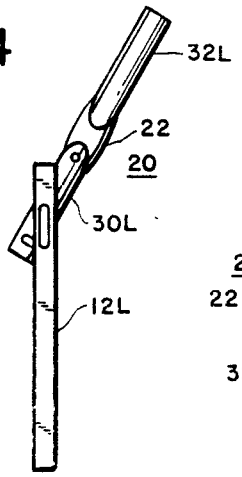
FIG. 5
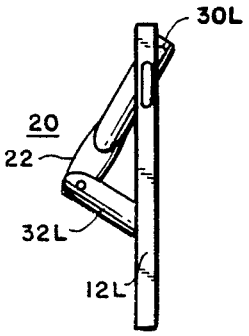
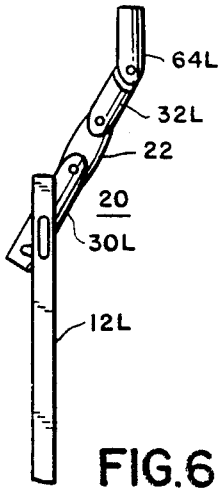
FIG. 6

SWINGING TOY

BACKGROUND OF THE INVENTION

1. Field of the Invention

This invention generally relates to toys, and more particularly to a swinging toy with rotating arms and legs.

2. Description of the Related Art

While toys such as dolls have moving arms and legs, no prior art search was made for more pertinent art and the inventor simply does not know of any more pertinent art.

SUMMARY OF THE INVENTION

It is a general object of the invention to provide an inexpensive toy in the form of a figure which can readily and simply be activated with only a minimum amount of energy.

It is another object of the invention to provide an inexpensive doll having movable arms and legs and which can do acrobatics.

It is further object of the invention to provide an inexpensive electrically-activated acrobatic doll.

Briefly, in accordance with the invention, these and other objects are achieved by a swinging toy comprising a U-shaped frame having two spaced parallel support rods and a connecting fulcrum rod. A figure comprises a body member simulating a head and shoulders with two arm members rotationally connected to the body member at the simulated shoulders. An outer string line is connected between the parallel support rods near one end of the frame and passes through inner openings of the arm members. An inner string line is connected between the parallel support rods parallel to and adjacent the outer string line and passes through outer openings of the arm members. When the frame is placed in a vertical position with the figure at the top, gravity will cause the body member to move around the inner and outer string lines to take an upside-up position below the inner string line, which causes the inner and outer string lines to cross each other, with one of the string lines in front of the other. When the ends of the parallel support rods at the bottom of the frame are moved toward each other, to pivot at the fulcrum rod and cause the top ends of the parallel support rods to move apart, the parallel string lines are pulled back to a parallel position so that the body member counter rotates around the inner and outer string lines back to an upside-up position beneath the inner string line, which causes the inner and outer string lines to cross each other, but in the opposite direction. Repeated movement toward each other of the bottom ends of the parallel support rods causes the body member to repeatedly rotate and counter rotate around the inner and outer string lines in acrobatic movements.

A feature of the invention is a pair of magnetizable bars connecting the parallel support bars together at the bottom of the H-frame via an electrically-operated solenoid to activate the figure by simply closing a switch.

Another feature of the invention is a guide bar slidingly connected to the bottom of the H-frame with a surrounding helical spring for preventing the bottom ends of the parallel support rods from being moved too close together and for urging the bottom ends apart when they are pushed together.

A further feature of the invention is a figure not only with rotatable arms but also with rotatable legs and knees to substantially enhance the acrobatic movements of the figure.

Still another feature of the invention is a U-shaped channel for guiding the bottom ends of the H-frame toward each other with the U-shaped channel supported on a weighted base so that the swinging toy is free standing.

A principal advantage of the invention is that it can easily be operated by a small child, or even an infant old enough to push a switch of an electrically-operated embodiment.

Other objects, features and advantages of the invention will be apparent from the following description of the preferred embodiments when read in connection with the figures of the accompanying two sheets of drawings.

BRIEF DESCRIPTION OF THE DRAWINGS

FIG. 1 (first sheet) is a perspective view of a swinging toy in accordance with the best mode of the invention in which the bottom ends of the H-frame slidingly move along a guide rod having a surrounding helical spring. Shown in dotted outline is the figure after partial rotation in an acrobatic movement when the lower ends of the paralell support rods are moved toward each other against the pressure of the helical spring.

FIG. 2 is a side elevational view of another embodiment of the swinging toy invention in which the bottom ends of the H-frame are free, and showing the figure rotating around the parallel string lines.

FIG. 2A is a side elevational view of an enlarged broken-away section of one of the parallel support rods of the embodiment of FIG. 2, showing how the fulcrum rod is nonrotationally connected to the parallel support rods.

FIG. 3 is a front elevational view, partly broken away, of still another embodiment of the invention in which the bottom ends of the H-frame are pulled together by an electrically-operated solenoid, and showing the figure in a vertical position above the then-parallel and tensed string lines.

FIG. 4 (second sheet) shows the figure, with just rotating arms, doing acrobatics as it rotates around the string lines.

FIG. 5 shows the figure, with both rotating arms and legs, doing acrobatics as it rotates around the string lines.

FIG. 6 shows the figure, with rotating arms, legs and knees, doing acrobatics as it rotates around the string lines.

FIG. 7 is a perspective view of still another embodiment of the invention, partly broken away in which the H-frame's bottom ends slidably engage a U-shaped channel, in turn mounted on a weighted base so that the swinging toy is free standing.

Corresponding parts of the various embodiments of the swinging toy invention bear the same reference characters.

DESCRIPTION OF THE PREFERRED EMBODIMENTS

Referring to FIG. 1, the disclosed swinging toy has an H-frame 10 having a pair of parallel support rods 12L and 12R and a fulcrum rod 16, with each end of the fulcrum rod 16 screw connected to a parallel support rod 12.

FIG. 20, simulating a clown doll, has a body member 22 with a simulated head 24, simulated shoulders 26L and 26R and simulated hips 28L and 28R. Rotatable arm's 30L and 30R are respectively pinned to simulated shoulders 26L and 26R, and rotatable legs 32L and 32R are respectively pinned to simulated hips 28L and 28R. Rotatable arm 30L ham an outer opening 34L and an inner opening 36L. Rotatable arm 30R has an outer opening 34R and an inner opening 36R.

At the bottom end of the H-frame 10 is a guide rod 40 with each end slidably connected to respective parallel support rods 12L and 12R via openings 42L and 42R, whose diameters are larger than the diameter of guide rod 40. The ends of guide rod 40 are maintained in the openings 42L and 42R by respective caps 44L and 44R. Surrounding guide rod 40 between the parallel support rods 12 is a helical spring 48. One purpose of the helical spring 48 is to limit the amount of inward movement of the bottom ends of the parallel support rods 12. The other purpose is to urge the bottom ends back to their original position.

At the top end of the H-frame 10, the top end of parallel support rod 12L has an outer opening 50L and an inner opening 52L. The top end of parallel support rod 12R has an outer opening 50R and an inner opening 52R.

Outer string line 56 (also see FIG. 3) passes through outer openings 50L and 50R of parallel support rods 12L and 12R via inner openings 36L and 36R in rotatable arms 30L and 30R. Inner string line 58 passes through inner openings 52L and 52R of parallel support rods 12L and 12R via outer openings 34L and 34R in rotatable arms 30L and 30R Outer string line 56 and inner string line 58 are connected together between outer openings 50 and inner openings 52 along the outside of each of the parallel support rods 12. That is, outer string line 56 and inner string line 58 comprise a single loop whose ends are connected together via a square knot 60 on the outer side of parallel support rod 12R (see FIG. 3).

Referring to the top end of the H-frame 10 shown in FIGS. 1–3, the FIG. 20 performs acrobatic rotations and counter rotations around the inner and outer string lines 56 and 58 by moving the bottom ends of the parallel support rods 12 toward each other. In the embodiment of the swinging toy shown in FIG. 1, that is done by pressing the ends toward each other while compressing helical spring 48. As the bottom ends of the parallel support rods 12 move together, they pivot at the fulcrum rod 16 causing the top ends of the parallel support rods 12 to move apart.

Preliminarily to operating the swinging toy, the H-frame 10 is placed in a vertical position, which causes the FIG. 20 to move by gravity beneath the inner and outer string lines 56 an 58. That gravitational movement causes the inner and outer string lines 56 and 58 to cross see FIG. 1) because the inner openings 36 in the rotating arms 30 are then below the outer openings 34 in the rotating arms 30, twisting the inner and outer string lines 56 and 58, with inner string line 58 being in front of outer string line 56.

When the bottom ends of parallel support rods 12 are mowed toward each other (FIG. 1, bottom dotted outline), string lines 56 and 58 are twisted back to a parallel tensed position (FIGS. 3 and 2, which provides a twisting torque lever force to the sections of the arms 30 between the inner and outer openings 34 and 86. That twisting torque lever force causes FIG. 20 to rotate rearwardly (FIG. 1, top dotted outline) and then around the string lines 56 and 58 (FIGS. 2 and 3) and return to the upside-up position beneath the string lines 56 and 58 (FIG. 1), but with outer string line 56 now in front of inner string line 58.

After the bottom ends of the parallel support rods 12 are moved toward each other to cause the rearward rotation of FIG. 20, the natural resiliency of parallel support rods 12 aided by the compressed helical spring 48 around guide rod 40 (FIG. 1) urges the bottom ends to their normal position with the lower sections (beneath the fulcrum rod 16) parallel to each other.

When the bottom ends of parallel support rods 12 are again moved toward each other, that again causes the string lines 56 and 58 to move to a parallel tensed position, this time causing the FIG. 20 to rotate forwardly and around the string lines 56 and 58 to the original position shown in FIG. 1.

Repeated movements of the bottom ends of parallel support rods 12 toward each other repeatedly causes the FIG. 20 to rotate around the string lines 56 and 58, first rearwardly and then forwardly. That causes the FIG. 20 to repeatedly somersault around the crisscrossing string lines 56 and 58 in acrobatic movements.

The amount of acrobatic movements depends on whether only the arms 30 are rotatable (second sheet, FIG. 4), or both the arms 30 and legs 32 are rotatable (FIGS. 1 and 5), or whether the arms 30, legs 32 and knees 64 (FIG. 6, with only knee 64L shown) are rotatable. When the knees 64 are rotatable, the upper and lower portions of the legs 82, above and below the knees 64, are also rotatable, to provide the maximum acrobatic movement. When the arms 30 are activated, the loosely connected parts move speedily ahead and with amplified force to bring the entire FIG. 20 to the opposite side of the string lines 58 and 60.

The function of the swinging toy is thus based on a continuous reversal of the positions of FIG. 20 in relation to the configuration of the string lines 58 and 60, from which FIG. 20 receives its programming for its motions and directions.

A continuous "On" and "Off" of the applied pressure is the main requirement to bring about the desired speeds and reversals from the state of tension to relaxation, and vice versa, and to assure the unceasing action of the swinging FIG. 20. The larger the frequency of intervals between repeated movement of the parallel support rods toward each other, the more intensive and abounding is the acrobatic performance of FIG. 20

To prevent the parallel support rods 12 (FIGS. 1 and 3) from rotating with respect to each other around the fulcrum rod 16, each end of fulcrum rod 16, to the width of parallel support rod 12, has a rectangular cross section which fits into a correspondingly shaped opening 66 (FIGS. 2 and 2A, only opening 66L is shown) which is covered by a cap 68 (only cap 68L is shown) of a screw which screws into the end of fulcrum rod 16. Thus, fulcrum rod 16 cannot rotate within the openings 66 of parallel support rods 12, which thus remain parallel to each other in a common vertical plane That is especially important in the FIG. 2 embodiment of the swinging toy because the bottom ends of the parallel support rods 12 are free of any connection between them.

The swinging toy shown in FIG. 3 is the same as that of FIG. 1. However, in place of manual movement cf the bottom ends of the parallel support rods 12 in FIG. 1, the FIG. 3 embodiment is electrically operated. Magnetizable rods 70L and 70R, at their outer ends, are respectively screw connected to parallel support rods 12L and 12R. The inner ends of magnetizable rods 70L and 70R are encompassed by a solenoid 72 which is electrically connected in series circuit with a battery voltage source 74 and a push-button switch 76.

When push-button switch 76 is pushed, it closes the electrical circuit causing the solenoid 72 to energize pulling each of the magnetizable rods 70L and 70R inward toward each other, in turn pulling the bottom ends of the parallel support rods 12 toward each other. That causes the top ends of parallel support rods 12 to move away from each other, in turn causing the string lines 56 and 58 to twist back into a parallel tensed position. Each twisting of string lines 56 and 58 into a parallel tensed position causes FIG. 20 to rotate around the string lines 66 and 58, first in one direction and then in the other, as explained above in the case of manual movement of the bottom ends of the parallel support rods 12 toward each other.

The manual movement of the bottom ends of parallel support rods 12 toward each other to activate FIG. 20 requires very little energy or strength because of the lever action of parallel support rods 12 around the fulcrum rod 16, and can easily be accomplished by a small child. And even an infant can be taught to push the push-button 76 closed to cause the FIG. 20 to do acrobatic movements in the FIG. 3 embodiment of the invention when the H-frame 10 is held by another person.

A free-standing embodiment of the swinging to invention is shown in FIG. 7. The portion of the swinging toy of FIG. 7 from fulcrum rod 16 up is the same as the FIG. 1 embodiment of the invention. And the H-frame 10 has the same free bottom ends of the parallel support rods 12 as the FIG. 2 embodiment of the invention. The main differences are as follows:

A guide post 80 (FIG. 7) is screw connected to guide rod I6 and depends downwardly parallel to the parallel support rods 12 into a container base 82 consisting of a removable cover 84, a cylindrically-shaped side wall 86 and a permanently attached bottom 88. The bottom end of the guide post 80 is screw connected to bottom 88 via an opening 89 in bottom 88. Attached to the top surface of removable cover 84 is a U-shaped guide channel 90 to receive the bottom ends of parallel support rods 12. The guide post 80 freely passes through an opening in the U-shaped guide channel 90 to attach to bottom 88.

In assembling the FIG. 7 embodiment of the invention, the guide post 80 is passed through the opening in the U-shaped guide channel 90 through closed cove 84 and positioned in opening 89 in bottom 88. Then the bottom end of guide post 80 is screwed to bottom 88 via a screw (not shown) from the outside of bottom 88. Then the bottom ends of the parallel support rods 12 are spread outwardly out of U-shaped guide channel 90 and the removable cover 84 lifted vertically along the guide post 80 so that the container base 82 can be filled with an inert material like sand, and then recovered to provide a stable weighted base for the swinging toy. Then the bottom ends of parallel support rods 12 are slid within the U-shaped guide channel 90.

The FIG. 20 can perform acrobatic movements by repeatedly moving the bottom ends of parallel support rods 12 toward each other within the U-shaped channel guide 90, as in the operation of the FIG. 2 embodiment of the swinging toy invention.

In still another embodiment of the swinging toy invention, the electrically-activated embodiment of FIG. 3 is combined with the free standing embodiment of FIG. 7, with the magnetizable rods 70 and solenoid 72 mounted within the channel of a nonmagnetizable U-shaped channel 90, so that the FIG. 7 embodiment can be switch operated by even an infant old enough to be able to push a switch.

In a typical embodiment of the swinging toy invention, the ratio of the spacing of the parallel rods 12 to the height of the H-frame 10 is about 1:4. Thus, is the parallel support rods 12 are spaced about three inches, as is preferred, the height of the H-frame 10 is about 12 inches. With three inch spacing of the parallel rods 12, their ends can be moved toward each other by the fingers of one hand.

The H-frame 10 and FIG. 20 are preferably made of a plastic like ABS, although wood may also be used with plastic, although aluminum may be used.

While FIG. 20 is shown as a clown doll, it may be of any human or animal shape, or even a partitioned inanimate object to achieve the desired swinging performance.

What is claimed is:

1. A swinging toy comprising:

(A) a frame comprising two spaced parallel support rods and a fulcrum rod orthogonally connected between said parallel support rods intermediate the ends of said parallel support rods;

(B) a guide means orthogonally and slidably connected to said parallel support rods adjacent one pair of ends of said parallel support rods;

(C) a figure comprising a body member simulating a head and shoulders at one end with two arm members rotationally connected to said body member at said simulated shoulders, each of said arm members having an outer opening adjacent its outer end and an inner opening near said outer opening;

(D) an outer string line connected between said parallel support rods near the other pair of ends of said parallel support rods and passing through each of said inner openings of said arm members;

(E) an inner string line connected between said parallel support rods substantially parallel to and adjacent said outer string line, and between said outer string line and said fulcrum rod, and passing through each of said outer openings of said arm members;

(F) whereby when said frame is placed in a substantially vertical position with said figure at the top and said guide means at the bottom, gravity will cause said body member to move around said inner and outer string lines to take an upside-up position between said parallel support rods with said body member below said inner and outer string lines, which causes said inner and outer string lines to cross each other, with one of said string lines in front of the other string line;

(G) when said one pair of ends of said parallel support rods slidably connected to said guide means are pressed toward each other along said guide means, said parallel support rods pivot at said fulcrum rod causing said other pair of ends of said parallel support rods to move away from each other to pull said inner and outer string lines back to a parallel position so that said body member counter rotates around said inner and outer string lines back to an upside-up position between said parallel support rods and beneath said inner string line, which causes said inner and outer string lines to cross each other, with said other of said string lines in front of said one of said string lines; and (H) wherein said guide means comprises a U-shaped channel and each of said one pair of ends of said parallel support rods slidably engages said U-shaped channel.

2. A swinging toy comprising:

(A) a frame comprising two spaced parallel support rods and a fulcrum rod orthogonally connected between said parallel support rods intermediate the ends of said parallel support rods;

(B) moving means orthogonally connected to said parallel support rods adjacent one pair of ends of said parallel support rods;

(C) a figure comprising a body member simulating a head and shoulders at one end with two arm members rotationally connected to said body member at said simulated shoulders, each of said arm members having an outer opening adjacent its outer end and an inner opening near said outer opening;

(D) an outer string line connected between said parallel support rods near the other pair of ends of said parallel support rods and passing through each of said inner openings of said arm members;

(E) an inner string line connected between said parallel support rods substantially parallel to and adjacent said outer string line, and between said outer string line and said fulcrum rod, and passing through each of said outer openings of said arm members;

(F) whereby when said frame is placed in a substantially vertical position with said figure at the top and said moving means at the bottom, gravity will cause aid body member to move around said inner and outer string lines to take an upside-up position between said parallel support rods with said body member below said inner and outer string lines, which causes said inner and outer string lines to cross each other, with one of said string lines in front of the other string line;

(G) when said one pair of ends of said parallel support rods connected to said moving means are moved toward each other, said parallel support rods pivot at said fulcrum rod causing said other pair of ends of said parallel support rods to move away from each other to pull said inner and outer string lines back to a parallel position so that said body member counter rotates around said inner and outer string lines back to an upside-up position between said parallel support rods and beneath said inner string line, which causes said inner and outer string lines to cross each other, with said other of said string lines in front of said one of said string lines; and wherein said moving means comprises:

(H) a pair of magnetizable rods, one magnetizable rod having an outside end orthogonally connected to one end of said one pair of ends of said parallel support rods and the other magnetizable rod having an outside end orthogonally connected to the other end of said one pair of ends of said parallel support rods;

(I) a solenoid having a longitudinal opening, said solenoid receiving through one side of said longitudinal opening the inside end of one of said pair of magnetizable rods and through the other side of said longitudinal opening the inside end of the other of said pair of magnetizable rods, said inside ends being spaced from each other inside said longitudinal opening;

(J) electrical circuit means electrically connected to said solenoid comprising in series a voltage source and a switch;

(K) whereby when said switch is actuated to close said electrical circuit means, said solenoid is energized and pulls each of said pair of magnetizable rods further into said longitudinal opening causing said one pair of ends of said parallel support rods connected to said moving means to move toward each other, whereby said parallel support rods pivot at said fulcrum rod causing said other pair of ends of said parallel support rods to move away from each other to pull said inner and outer string lines back to a parallel position so that said body member counter rotates around said inner and outer string lines back to an upside-up position between said parallel support rods and beneath said inner string line, which causes said inner and outer string lines to cross each other, with said other of said string lines in front of said one of said string lines.

3. The swinging toy of claim 2 whereby repeated closing of said switch causes said body member to repeatedly rotate and counterrotate around said inner and outer string lines.

4. The swinging toy of claim 2 wherein said switch is a push-button switch.

5. The swinging toy of claim 2 wherein said voltage source is a battery.

6. A swinging toy comprising:

(A) a frame comprising two spaced parallel support rods and a fulcrum rod orthogonally connected between said parallel support rods intermediate the ends of said parallel support rods;

(B) a guide means orthogonally and slidably connected to said parallel support rods adjacent one pair of ends of said parallel support rods;

(C) a figure comprising a body member simulating a head and shoulders at one end with two arm members rotationally connected to said body member at said simulated shoulders, each of said arm members having an outer opening adjacent its outer end and an inner opening near said outer opening;

(D) an outer string line connected between said parallel support rods near the other pair of ends of said parallel support rods and passing through each of said inner openings of said arm members;

(E) an inner string line connected between said parallel support rods substantially parallel to and adjacent said outer string line, and between said outer string line and said fulcrum rod, and passing through each of said outer openings of said arm members;

(F) whereby when said frame is placed in a substantially vertical position with said figure at the top and said guide means at the bottom, gravity will cause said body member to move around said inner and outer string lines to take an upside-up position between said parallel support rods with said body member below said inner and outer string lines, which causes said inner and outer string lines to cross each other, with one of said string lines in front of the other string line;

(G) when said one pair of ends of said parallel support rods slidably connected to said guide means are pressed toward each other along said guide means, said parallel support rods pivot at said fulcrum rod causing said other pair of ends of said parallel support rods to move away from each other to pull said inner and outer string lines back to a parallel position so that said body member counter rotates around said inner and outer string lines back to an upside-up position between said parallel support rods and beneath said inner string line, which causes said inner and outer string lines to cross each other, with said other of said string lines in front of said one of said string lines; and wherein said guide means comprises a U-shaped channel and each of said one pair of ends of said parallel support rods slidably engages said U-shaped channel, and a channel support means comprising:

(H) a base having a top, side and bottom;

(I) said U-shaped channel being connected to the top of said base and having an opening intermediate its ends; and (J) a support rod orthogonally connected to said fulcrum rod and passing through said opening and connecting to the bottom of said base.

7. The swinging toy of claim 6 wherein said base is a cylindrical container adapted to be filled with a material to increase its weight and thereby provide a more stable base for said swinging toy.

8. The swinging toy of claim 6 wherein said guide means further comprises:

(A) a pair of magnetizable rods positioned in the channel of said U-shaped channel, said U-shaped channel being nonmagnetizable, one magnetizable rod having an outside end orthogonally connected to one end of said one pair of ends of said parallel support rods and the other magnetizable rod having an outside end orthogonally connected to the other end of said one pair of ends of said parallel support rods;

(B) a solenoid also positioned in the channel of said U-shaped channel, said solenoid having a longitudinal opening, said solenoid receiving through one side of said longitudinal opening the inside end of one of said pair of magnetizable rods and through the other side of said longitudinal opening the inside end of the other of said pair of magnetizable rods, said inside ends being spaced from each other inside said longitudinal opening;

(C) electrical circuit means electrically connected to said solenoid comprising in series a voltage source and a switch;

(D) whereby when said switch is actuated to close said electrical circuit means, said solenoid is energized and pulls each of said pair of magnetizable rods further into said longitudinal opening causing said one pair of ends of said parallel support rods connected to said moving means to move toward each other, whereby said parallel support rods pivot at said fulcrum rod causing said other pair of ends of said parallel support rods to move away from each other to pull said inner and outer string lines back to a parallel position so that said body member counter rotates around said inner and outer string lines back to an upside-up position between said parallel support rods and beneath said inner string line, which causes said inner and outer string lines to cross each other, with said other of said string lines in front of said one of said string lines.

9. The swinging toy of claim 8 wherein said base is a cylindrical container adapted to be filled with a material to increase its weight and thereby provide a more stable base for said swinging toy.

* * * * *